US008745796B2

(12) United States Patent
Liu

(10) Patent No.: US 8,745,796 B2
(45) Date of Patent: Jun. 10, 2014

(54) SENSING DEVICE FOR AIR CUSHION BED

(75) Inventor: Tsung Hsuan Liu, Taipei (TW)

(73) Assignee: Caremed Supply Inc., New Taipei (TW)

( * ) Notice: Subject to any disclaimer, the term of this patent is extended or adjusted under 35 U.S.C. 154(b) by 0 days.

(21) Appl. No.: 13/465,333

(22) Filed: May 7, 2012

(65) Prior Publication Data

US 2013/0291310 A1 Nov. 7, 2013

(51) Int. Cl.
*A47C 27/10* (2006.01)

(52) U.S. Cl.
USPC ..... 5/710; 5/706; 5/711; 5/713; 5/655.3

(58) Field of Classification Search
CPC ..... A61G 7/05776; A61G 2203/34; A47C 27/082; A47C 27/083; A47C 27/10; A47C 31/123
USPC ..... 5/706, 710, 711, 713, 655.3
See application file for complete search history.

(56) References Cited

U.S. PATENT DOCUMENTS 5,611,096 A * 3/1997 Bartlett et al. ..... 5/617
5,634,225 A * 6/1997 Miller et al. ..... 5/710
5,715,548 A * 2/1998 Weismiller et al. ..... 5/624
5,963,997 A * 10/1999 Hagopian ..... 5/654
6,014,784 A * 1/2000 Taylor et al. ..... 5/713
6,154,907 A * 12/2000 Cinquin ..... 5/713
6,269,505 B1 * 8/2001 Wilkinson ..... 5/713
6,560,804 B2 * 5/2003 Wise et al. ..... 5/713
6,813,790 B2 * 11/2004 Flick et al. ..... 5/713
7,107,642 B2 * 9/2006 Wong et al. ..... 5/713
7,380,302 B2 * 6/2008 Gilchrest et al. ..... 5/732

* cited by examiner

*Primary Examiner* — William Kelleher
*Assistant Examiner* — Duoni Pan
(74) *Attorney, Agent, or Firm* — Shimokaji & Associates P.C.

(57) ABSTRACT

A sensing device is configured for placing in an air cushion bed below air bladders thereof to detect an exact state of the bed in use, and includes a first and a second sheet connected together to define an air chamber therebetween. The air bladders and the air chamber are communicable with one another via inflation valves on the first sheet and are synchronously and identically inflated. First and second sensing elements are disposed outside and inside the air chamber, respectively. The first sensing element has deformation and acceleration sensors arranged thereon for monitoring how the bed reacts to a patient lying thereon and the manner in which the bed is being used. The second sensing element includes upper and lower conductive sensing sheets and an electrical connection state therebetween is used to detect whether the air bladders are sufficiently inflated. Thus, the air cushion bed is safer for use.

9 Claims, 7 Drawing Sheets

SENSING DEVICE FOR AIR CUSHION BED

FIELD OF THE INVENTION

The present invention relates to an air cushion bed, and more particularly to a sensing device capable of detecting the inflation state of air bladders of an air cushion bed and monitoring the condition of a patient lying on the air cushion bed to increase the use safety of the air cushion bed.

BACKGROUND OF THE INVENTION

People who are not able to freely move around or get out of bed due to illness are usually confined to bed. A bedridden patient is prone to bedsores, which are local tissue necrosis caused by prolonged pressure on and insufficient blood flow to the skin and muscles that continuously contact with the bed. Almost all the bedridden patients are suffering from bedsores, which cause uncomfortable skin ulceration or even septicemia and amputation in worse conditions.

A common way to minimize the development of bedsores in a bedridden patient is to help the patient to change his or her lying position by, for example, rolling him or her over from one position to another periodically, such as every one or two hours, so as to avoid continuous pressure on the same body areas. The bedridden patients have become a heavy burden to nurses because a lot of time and energy is required to help the patients to change their lying position.

Therefore, air cushion beds are developed and introduced into the market for the purpose of preventing bedridden patients from forming bedsores. Generally, an air cushion bed internally includes a plurality of air bladders that can be alternately inflated and deflated. By inflating and deflating the air bladders alternately, it is possible to alternately and temporarily relieve different areas of the bedridden patient's body from prolonged pressure and accordingly reduce the possibility of developing bedsores. However, in the event the air bladders are insufficiently inflated, the air cushion bed is almost useless in terms of relieving the prolonged pressure on the bedridden patient's skin. On the other hand, in the event the air bladders are excessively inflated, the patient might undesirably slip down the air cushion bed.

It is therefore necessary to develop an air cushion bed that includes additional and better functions of determining whether there is a patient lying on the air cushion bed and whether the air bladders of the air cushion bed are properly inflated when a patient is lying thereon the bed.

SUMMARY OF THE INVENTION

A primary object of the present invention is to effectively improve the safety of an air cushion bed in use by providing a sensing device capable of detecting the state of the air cushion bed in use, so that the air cushion bed with the sensing device laid below it not only has the functions of detecting whether there is a patient lying on the bed and monitoring the condition of inflatable air bladders in the air cushion bed when a patient is lying on the bed, but also the function of detecting the manner in which the air cushion bed is being used.

Another object of the present invention is to provide a sensing device that largely upgrades the accuracy in monitoring the inflation condition of air bladders in an air cushion bed by communicating the sensing device with the air bladders, so that they are synchronously and identically inflated.

To achieve the above and other objects, the sensing device according to the present invention is configured for placing in an air cushion bed outside a plurality of air bladders thereof. In a most preferred manner, the sensing device is laid below lower surfaces of the air bladders at a position generally corresponding to a patient's buttock area when the patient is lying on the air cushion bed.

According to the present invention, the sensing device includes a first sheet, a second sheet, a first sensing element, and a second sensing element. In a preferred embodiment of the sensing device, the first sheet and the second sheet are connected together to define an air chamber between them, and at least one inflation valve is provided on the first sheet for connecting an external tube system to communicate the air chamber with the air bladders of the air cushion bed via the tube system.

The first sensing element is disposed outside the air chamber, and has at least one deformation sensor and at least one acceleration sensor provided thereon. The second sensing element is arranged inside the air chamber, and includes an upper conductive sensing sheet attached to an inner top of the air chamber and a lower conduction sensing sheet attached to an inner bottom of the air chamber. The deformation sensor is configured as a metal sensing chip and is located atop a central area of the air chamber. And, multiple conductive pads are spaced on areas of both the upper and lower conductive sensing sheets at two lateral sides of the deformation sensor.

In an operable embodiment, the first sensing element includes a third sheet having a connection section located atop the first sheet and at least one extension section projected from the connection section to locate beyond the first sheet. The deformation sensor is provided on the connection section of the third sheet, and the acceleration sensor is provided on the extension section of the third sheet. With these arrangements, the deformation sensor, the upper conductive sensing sheet and the lower conductive sensing sheet all are located corresponding to the buttock area of a patient lying on the bed, while the acceleration sensor alone is located beyond the patient's buttock area to correspond to the patient's upper half of body.

The sensing device of the present invention further includes a monitoring device externally electrically connected to the first and second sensing elements, so as to analyze and determine data from the deformation sensor and the acceleration sensor as well as an electrical connection state between the upper and the lower conductive sensing sheet.

From a contacting state between the upper conductive sensing sheet and the lower conductive sensing sheet, the monitoring device can examine whether the air bladders are sufficiently inflated. From different angular positions of the acceleration sensor on the air cushion bed, the monitoring device can determine the manner in which the air cushion bed is being used. And, by analyzing a deformation amount as well as positive and negative electricity amounts of the metal sensing chip of the deformation sensor, the monitoring device can monitor how the air cushion bed reacts to a patient lying thereon.

The present invention is characterized in that the first and the second sensing element are respectively arranged outside and inside the air chamber defined between the connected first and second sheets of the sensing device, so that the air cushion bed with the sensing device placed therein below the air bladders thereof has three major functions of detecting whether there is a patient lying on the bed, monitoring the condition of inflatable air bladders in the air cushion bed when a patient is lying on the bed, and detecting the manner in which the air cushion bed is being used. Further, with the air chamber being communicable with the air bladders via inflatable valves provided on the first sheet and connected to an external tube system, the air chamber and the air bladders can be synchronously and identically inflated to largely increase the accuracy in monitoring the inflation state of the air bladders.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
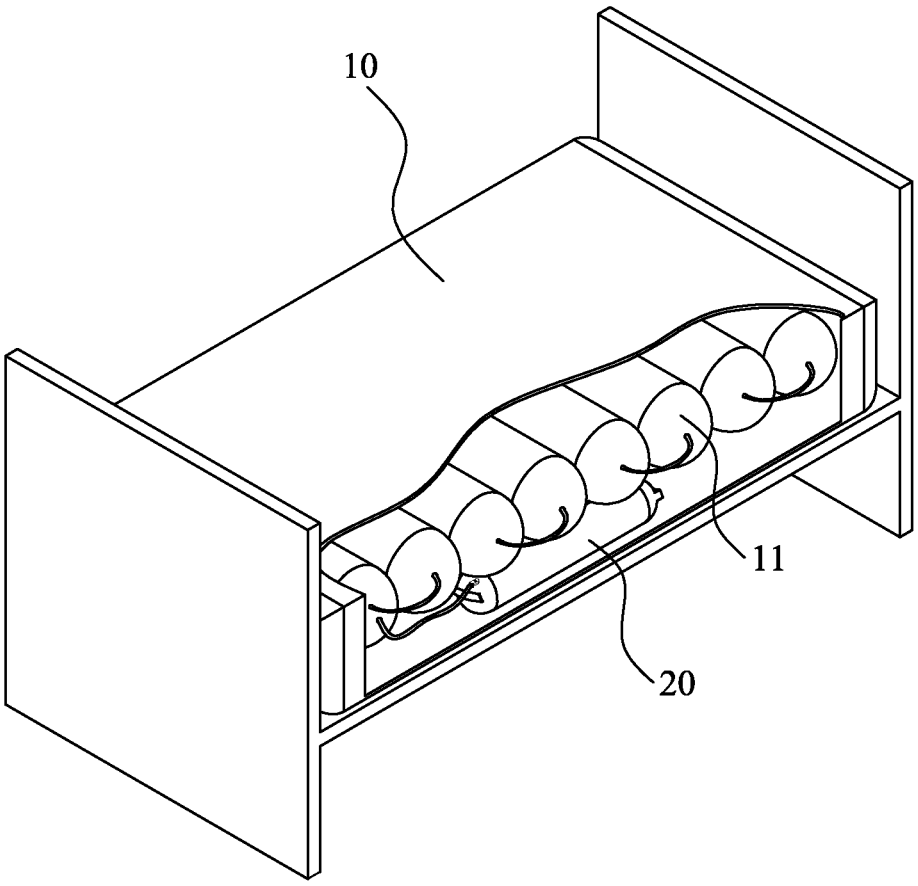
FIG. 1 is a cutaway view of an air cushion bed with a sensing device of the present invention laid below air bladders in the air cushion bed.

Please refer to FIG. 1. The present invention provides a sensing device 20 which is mainly placed in an air cushion bed 10 outside a plurality of air bladders 11 thereof. In a most preferred manner, the sensing device 20 is laid below lower surfaces of the air bladders 11.

Figure 2:
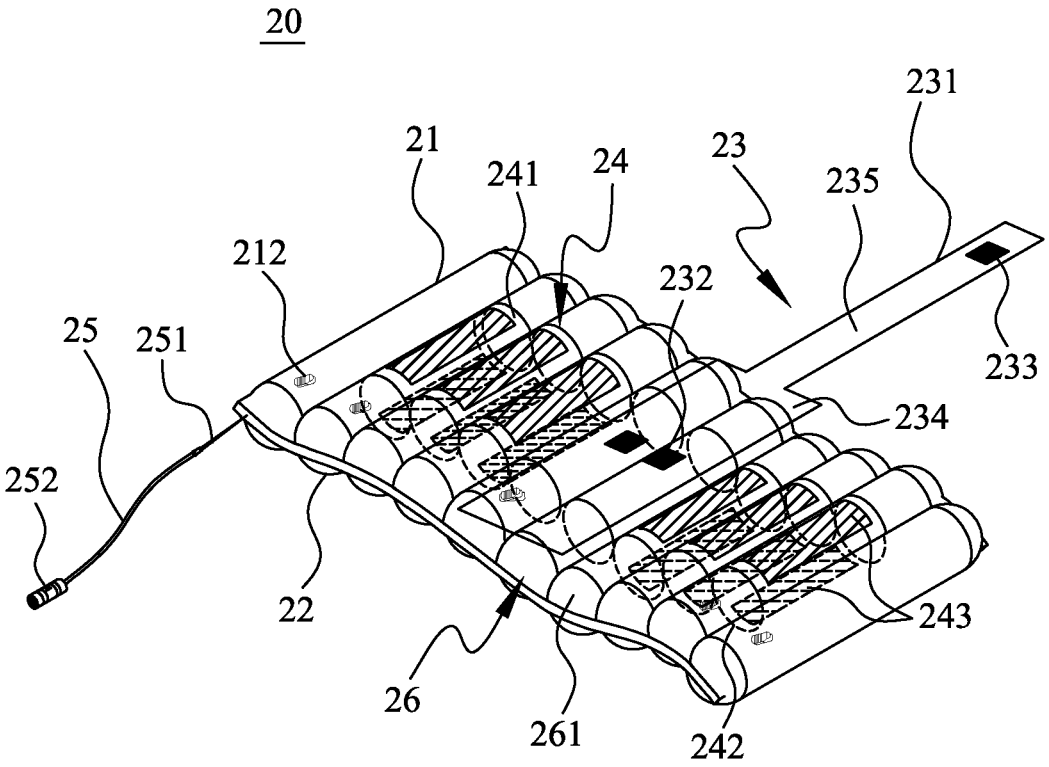
FIG. 2 is an assembled perspective view of the sensing device for air cushion bed according to a preferred embodiment of the present invention.
Figure 3:
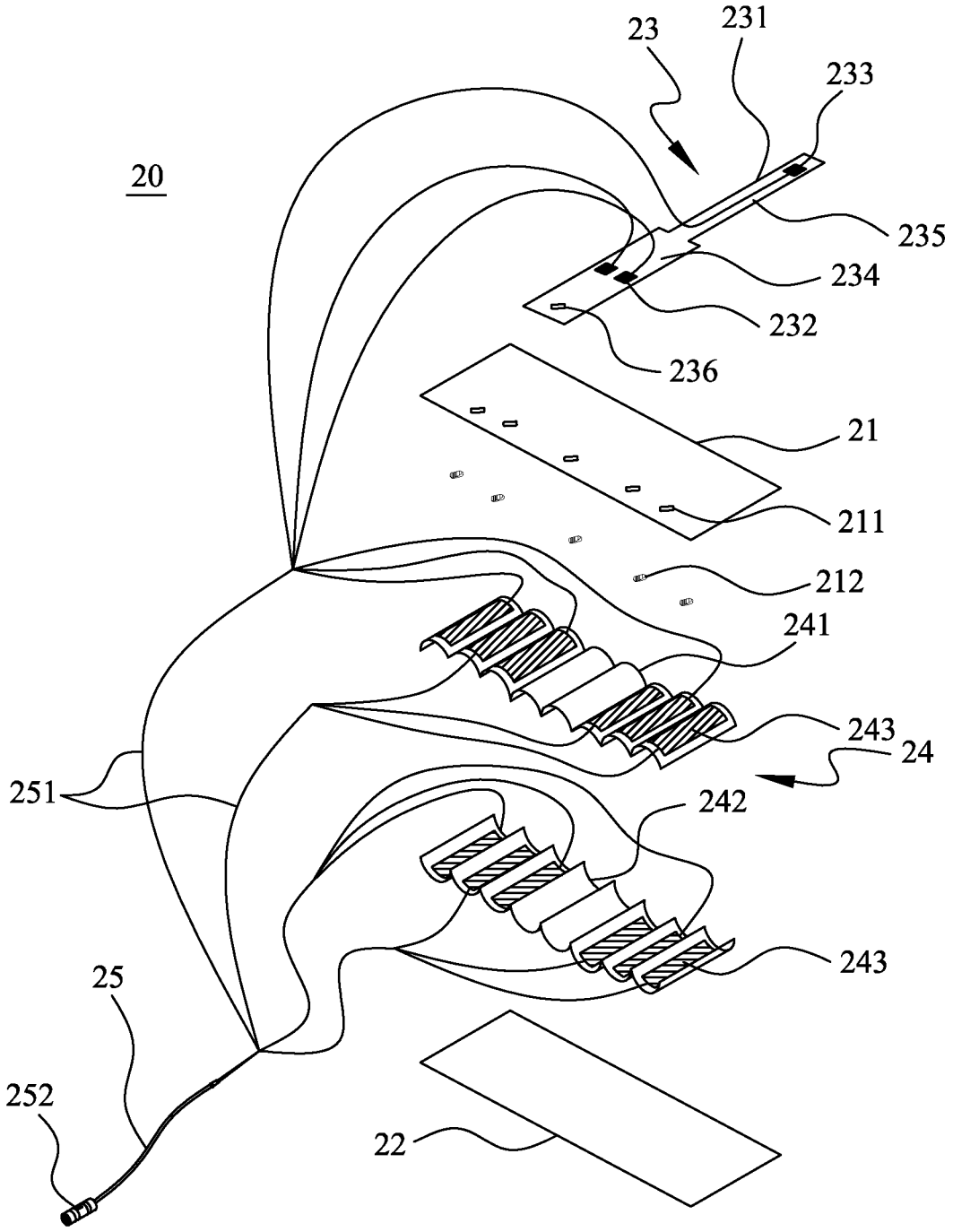
FIG. 3 is an exploded view of FIG. 2.

FIGS. 2 and 3 are assembled and exploded perspective views, respectively, of the sensing device 20 according to a preferred embodiment of the present invention. As shown, the sensing device 20 includes a first sheet 21, a second sheet 22, a first sensing element 23, a second sensing element 24, and a connecting cable 25. The first sheet 21 and the second sheet 22 are correspondingly shaped and are connected to each other along their peripheral edges to thereby define an air chamber 26 between them. The first sheet 21 is provided with a row of holes 211, to each of which an inflation valve 212 is connected. In the illustrated preferred embodiment, the air chamber 26 includes a plurality of parallelly arrayed and spaced compartments 261, and the inflation valves 212 are provided on some of the compartments 261 that are located at a center and near two lateral ends of the air chamber 26.

The first sensing element 23 is located outside the air chamber 26, and includes a third sheet 231, two deformation sensors 232 and an acceleration sensor 233. The third sheet 231 is disposed on a top central area of the air chamber 26, and includes a connection section 234 located atop the first sheet 21 and an extension section 235 projected from the connection section 234 to locate beyond the first sheet 21. The deformation sensors 232 and the acceleration sensor 233 are arranged on the connection section 234 and the extension section 235, respectively, of the third sheet 231. In an operable embodiment, the connection section 234 has a hole 236 formed at a position corresponding to the inflation valve 212 on the central compartment 261 of the air chamber 26, allowing the connection section 234 to be fitted around the central inflation valve 212 and held to the first sheet 21. Further, the deformation sensors 232 are respectively a metal sensing chip.

It is understood the above-described first sensing element 23 is only illustrative and not intended to restrict the structural configuration of the third sheet 231 and the number of the deformation sensors 232 and the acceleration sensor 233. That is, the third sheet 231 may be configured to have more than one extension section 235 and there may be more than one acceleration sensor 233 to match the number of the extension sections 235. Meanwhile, the number of the deformation sensors 232 may also be increased to enable upgraded monitoring accuracy of the sensing device 20.

The second sensor element 24 is located inside the air chamber 26, and includes an upper conductive sensing sheet 241 attached to an inner upper side of the air chamber 26, or a lower face of the first sheet 21, and a lower conductive sensing sheet 242 attached to an inner lower side of the air chamber 26, or an upper face of the second sheet 22. Multiple conductive pads 243 are spaced on areas of both the upper conductive sensing sheet 241 and the lower conductive sensing sheet 242 at two lateral sides of the deformation sensors 232.

The connecting cable 25 is a bunched cable containing multiple small cables 251. The small cables 251 have one end electrically connected to the two deformation sensors 232, the acceleration sensor 233, and the conductive pads 243 of the second sensing element 24, respectively, and another opposite end bunched into a plug 252.

Figure 4:
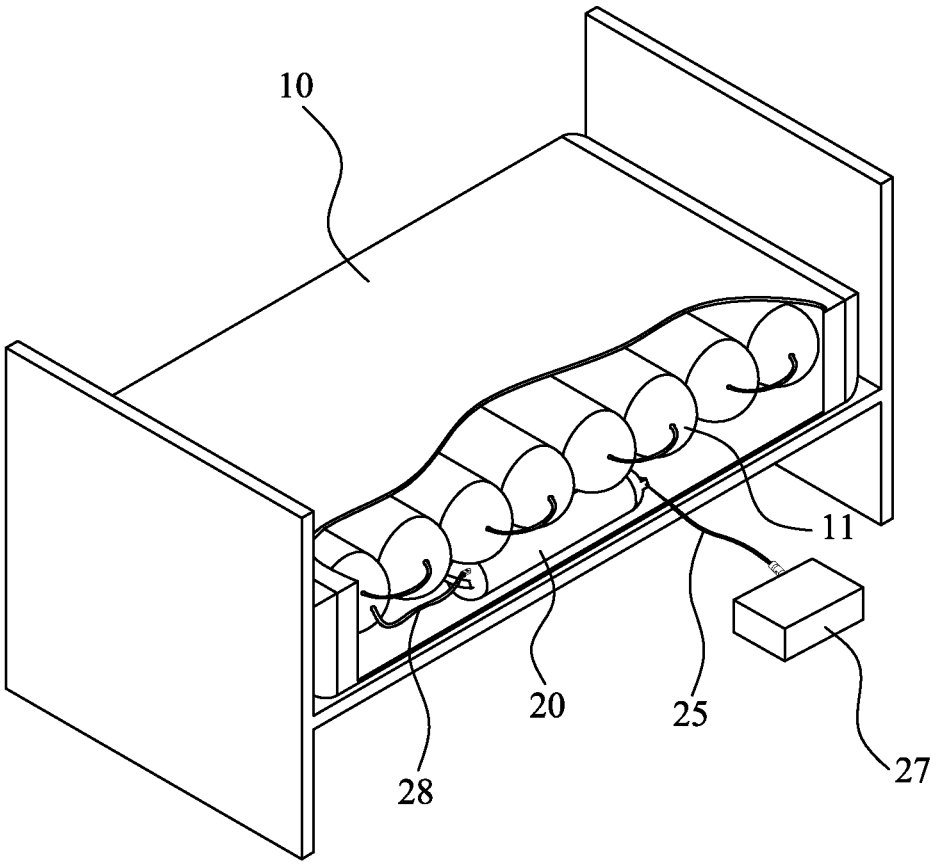
FIG. 4 is a cutaway view showing the sensing device of the present invention is electrically connected to an external monitoring device.

Please refer to FIG. 4. The sensing device 20 of the present invention may be further connected to a monitoring device 27 via the plug 252 of the connecting cable 25, so that the monitoring device 27 is electrically connected to the first sensing element 23 and the second sensing element 24 for analyzing and determining data from the deformation sensors 232 and the acceleration sensor 233, as well as an electrical connection state between the upper conductive sensing sheet 241 and the lower conductive sensing sheet 242.

From a contacting state between the upper conductive sensing sheet 241 and the lower conductive sensing sheet 242, the monitoring device 27 can examine whether the air bladders 11 are sufficiently inflated. From different angular positions of the acceleration sensor 233 on the air cushion bed 10, the monitoring device 27 can determine the manner in which the air cushion bed 10 is being used. And, by analyzing a deformation amount as well as positive and negative electricity amounts of the metal sensing chips 232, the monitoring device 27 can monitor how the air cushion bed 10 reacts to a patient lying thereon.

Figure 5:
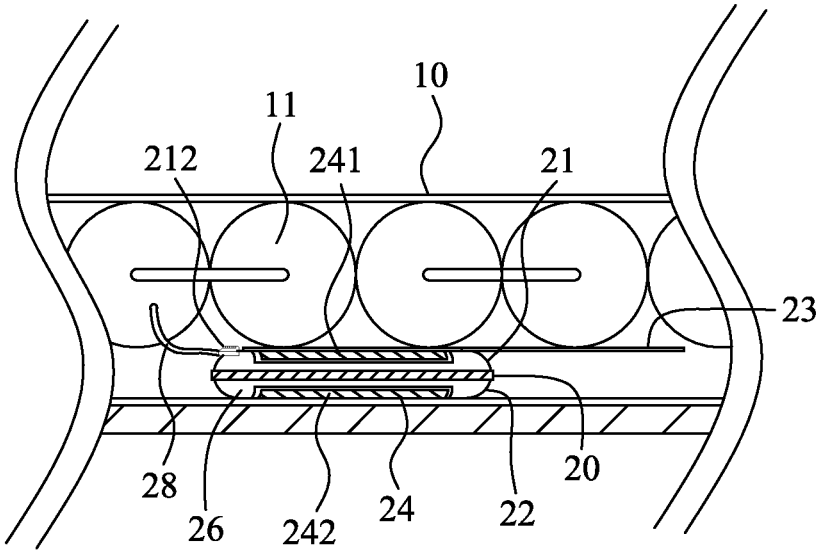
FIG. 5 is fragmentary sectional view showing the communication between an air chamber of the sensing device of the present invention and air bladders of the air cushion bed.

Please refer to FIG. 5. The inflation valves 212 are connected to the air bladders 11 in the air cushion bed 10 via an external tube system 28, so that air in the air chamber 26 is communicable with air in the air bladders 11 via the tube system 28, allowing the air bladders 11 and the air chamber 26 to be synchronously and identically inflated.

Figure 6:
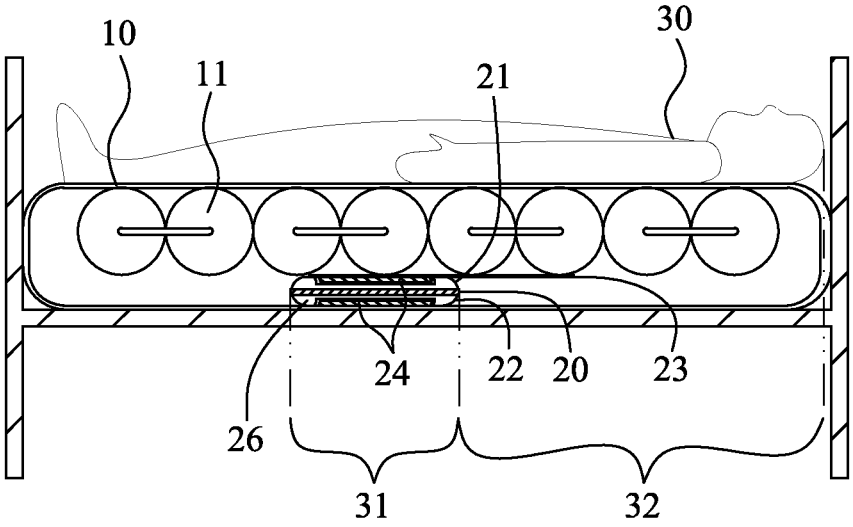
FIG. 6 is a schematic sectional view showing deformation sensors and conductive sensing sheets of the sensing device of the present invention are located below the air bladders substantially corresponding to the buttock area of a patient lying on the air cushion bed.

As can be seen in FIG. 6, the sensing device 20 of the present invention in use has a position generally corresponding to a patient's buttock area 31 when the patient 30 is lying on the air cushion bed 10. With the sensing device 20 being located corresponding to the patient's buttock area 31, the deformation sensors 232, the upper conductive sensing sheet 241 and the lower conductive sensing sheet 242 all are located corresponding to the patient's buttock area 31. However, since the acceleration sensor 233 is arranged on the extension section 235 of the third sheet 231, the acceleration sensor 233 alone is located outside the patient's buttock area 31 to correspond to an upper half 32 of the body of the patient 30 lying on the bed 10.

Figure 7:
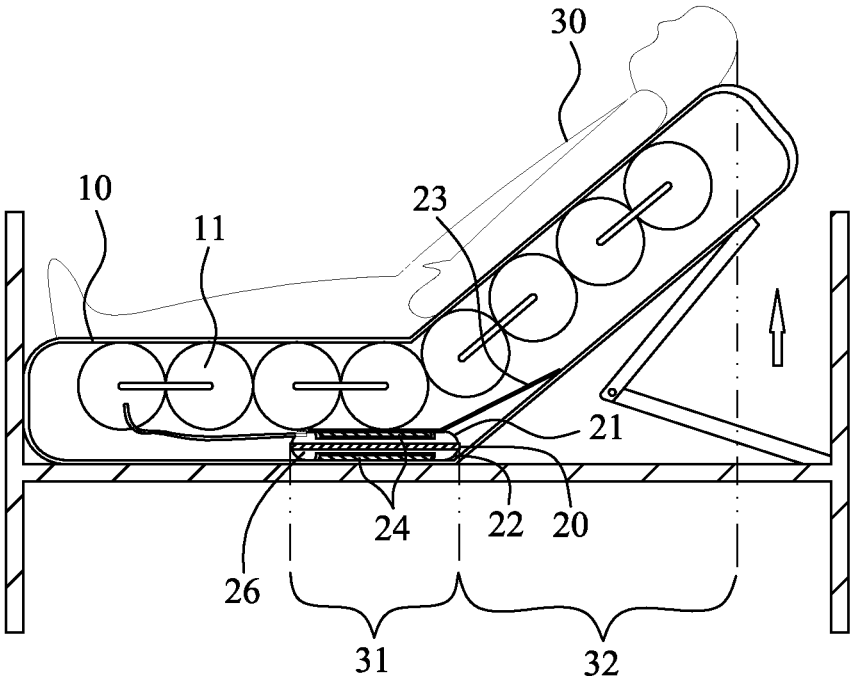
FIG. 7 is a schematic sectional view showing an acceleration sensor of the sensing device of the present invention is located below the air bladders substantially corresponding to an upper half of the body of a patient lying on the air cushion bed, and is changeable to different angular positions when a head portion of the bed is elevated by different inclination angles.

When a head portion of the air cushion bed 10 is elevated to an inclined position as shown in FIG. 7, the acceleration sensor 233 located corresponding to the upper half 32 of the body of the patient 30 is lifted along with the elevated head portion of the air cushion bed 10 to an angular position. At this point, the acceleration sensor 233 can transmit data about the angle at which the patient 30 is currently lying on the air cushion bed 10 to the monitoring device 27, so that the monitoring device 27 can change values preset for monitoring the deformation amount as well as the positive and negative electricity amounts of the metal sensing chips 232. In this manner, it is able to accurately monitor the exact state of the patient 30 lying on the air cushion bed 10 and enable the air cushion bed 10 to automatically regulate the alternate inflation and deflation of air bladders 11 at different positions according to the monitored user state, so as to alternately and temporarily relieve different areas of the bedridden patient's body from prolonged pressure in the best possible manner.

In brief, an air cushion bed with the sensing device according to the present invention can provide three major functions of detecting whether there is a patient lying on the air cushion bed, whether the air bladders in the air cushion bed are properly inflated when a patient is lying on the air cushion bed, and how the air cushion bed is being used, and can therefore have effectively improved safety in use. Further, since the air chamber of the sensing device and the air bladders of the air cushion bed are synchronously and identically inflated or deflated, the accuracy in monitoring the inflation state of the air bladders is largely upgraded.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A sensing device in an air cushion bed outside a plurality of air bladders, comprising:

a first sheet including a plurality of inflation valves;

a second sheet connected to the first sheet, such that an air chamber is formed between the connected first and second sheets, wherein the air chamber is communicable with the air bladders in the air cushion bed via the plurality of inflation valves connected to an external tube system, the air chamber and the air bladders being synchronously and identically inflated, wherein the air bladders are enclosed compartments within the air chamber and the air chamber is an enclosed compartment; and wherein the plurality of inflation valves are located at a center and near two lateral ends of the air chamber;

a first sensing element disposed outside the air chamber and having at least one deformation sensor and at least one acceleration sensor provided thereon; and a second sensing element disposed inside the air chamber, and including an upper conductive sensing sheet attached to an inner upper side of the air chamber and a lower conductive sensing sheet attached to an inner lower side of the air chamber; and a monitoring device electrically connected to the first and the second sensing elements configured to determine and analyze data from the deformation sensor and the acceleration sensor, wherein the monitoring device is further configured to determine and analyze an electrical connection state between the upper conductive sensing sheet and the lower conductive sensing sheet, wherein the monitoring device is configured to detect whether the air bladders are sufficiently inflated via a contacting state between the upper conductive sensing sheet and the lower conductive sensing sheet.

2. The sensing device for the air cushion bed as claimed in claim 1, wherein the first sensing element further includes a third sheet having a connection section located atop the first sheet and at least one extension section projected from the connection section beyond the first sheet.

3. The sensing device for the air cushion bed as claimed in claim 2, wherein the deformation sensor is provided on the connection section and the acceleration sensor is provided on the extension section.

4. The sensing device for the air cushion bed as claimed in claim 1, wherein the sensing device is placed in the air cushion bed at a position corresponding to a patient's buttock area when the patient is lying on the air cushion bed.

5. The sensing device for the air cushion bed as claimed in claim 4, wherein the deformation sensor, the upper conductive sensing sheet and the lower conductive sensing sheet are located corresponding to the patient's buttock area, and the acceleration sensor is located outside the patient's buttock area to correspond to the patient's upper half of body.

6. The sensing device for the air cushion bed as claimed in claim 1, wherein the sensing device is placed in the air cushion bed below a plurality of lower surfaces of the air bladders.

7. The sensing device for the air cushion bed as claimed in claim 1, wherein the deformation sensor is located atop a central area of the air chamber, and wherein multiple conductive pads are spaced on areas of both the upper conductive sensing sheet and the lower conductive sensing sheet at two lateral sides of the deformation sensor.

8. The sensing device for the air cushion bed as claimed in claim 1, wherein the monitoring device detects a manner in which the air cushion bed is being used via different angular positions of the acceleration sensor on the patient's upper half of body of the air cushion bed.

9. The sensing device for the air cushion bed as claimed in claim 1, wherein the deformation sensor is a metal sensing chip, and the monitoring device detecting how the air cushion bed reacts to a patient lying thereon by analyzing a deformation amount as well as positive and negative electricity amounts of the metal sensing chip.

* * * * *